United States Patent [19]

Enzian, Jr.

[11] 4,346,664

[45] Aug. 31, 1982

[54] LIFEBOAT

[76] Inventor: Clayton T. Enzian, Jr., 3 Edgewater Dr., Wareham, Mass. 02571

[21] Appl. No.: 244,162

[22] Filed: Mar. 16, 1981

Related U.S. Application Data

[62] Division of Ser. No. 881,644, Feb. 27, 1978, Pat. No. 4,274,171.

[51] Int. Cl.[3] ..... B63C 9/06

[52] U.S. Cl. ..... 114/349; 114/201 R; 114/311; 114/357

[58] Field of Search ..... 9/4 R, 4 A, 3, 6 P; 114/330, 335, 201 R, 311

[56] References Cited

U.S. PATENT DOCUMENTS

| | | | |
|---|---|---|---|
| 211,807 | 1/1879 | Tremberger et al. | 9/3 |
| 348,424 | 8/1886 | Shears | 114/349 |
| 603,532 | 5/1898 | Mitchell, Sr. | 114/349 |
| 663,172 | 12/1900 | Hoy | 114/349 |
| 731,500 | 6/1903 | Ridgway | 114/201 R |
| 934,322 | 9/1909 | King | 441/87 |
| 1,295,893 | 3/1919 | Hartz | 114/349 |
| 1,801,480 | 4/1931 | Barnett | 114/349 |
| 1,906,683 | 5/1933 | Pietrzykowski | 114/349 |
| 2,431,061 | 11/1947 | Mayo | 114/349 |
| 2,899,695 | 8/1959 | Nicol | 114/349 |
| 3,259,926 | 7/1966 | Otterman | 114/349 |
| 3,388,688 | 6/1968 | Barhite et al. | 114/16 |
| 3,435,470 | 4/1969 | Krenzler | 9/6 |
| 4,274,171 | 6/1981 | Enzian, Jr. | 9/4 R |

FOREIGN PATENT DOCUMENTS

| | | | |
|---|---|---|---|
| 449761 | 2/1913 | France | 9/4 R |
| 14420 | 2/1904 | Norway | 9/4 R |
| 395303 | 12/1973 | U.S.S.R. | 9/4 R |
| 23645 | of 1912 | United Kingdom . | |

OTHER PUBLICATIONS

Parade Magazine, Oct. 9, 1977, p. 6.
National Fisherman, Sep. 1976, p. 10–B.
Cape Cod Times, "This Boat Can't Sink," May 9, 1976, pp. 1 and 3.
Cape Cod Times, "Wareham Tinkers," May 12, 1977, p. 12.

*Primary Examiner*—Trygve M. Blix
*Assistant Examiner*—Thomas J. Brahan
*Attorney, Agent, or Firm*—Blodgett and Blodgett

[57] ABSTRACT

Lifeboat in the general form of a hollow prolate spheroid having a hatchway opening in the upper portion and a weighted keel in the lower portion. The lifeboat comprises a main body having inner and outer skins spaced apart in a parallel relationship and a hollow ballast element extends entirely around the periphery of the inner chamber at the bottom and is divided by transverse walls into a plurality of fresh water compartments which also has a flat upper surface for use as a seat. The ballast element also includes a water compartment beneath the floor at the bottom portion of the inner chamber.

5 Claims, 10 Drawing Figures

LIFEBOAT

This is a division of application Ser. No. 881,644, filed Feb. 27, 1978, now U.S. Pat. No. 4,274,171.

BACKGROUND OF THE INVENTION

In the design and manufacture of lifeboats, there are many desirable characteristics which are difficult to incorporate in a single structure. Those boats that are extremely buoyant are apt to be unstable. Those boats that are inexpensive to manufacture are likely to be easily rendered inoperative by the elements. One of the popular lifeboats, for instance, has a tendency to turn upside down and to remain in that condition. The ideal lifeboat should be capable of being projected into the water in any geometric position relative to the horizontal and still immediately turn to its proper upright position. Attempts to provide lifeboats of this type in the past have resulted in a structure that is both expensive and complicated. These and other difficulties experienced with the prior art devices have been obviated in a novel manner by the present invention.

It is, therefore, an outstanding object of the invention to provide a lifeboat which is simple and rugged in construction and which has no loose, complex, or fragile parts that can become broken or inoperative in heavy seas.

Another object of this invention is the provision of a lifeboat which requires little or no attention from its passengers, so that it is capable of protecting persons in a weakened or injured condition.

A further object of the present invention is the provision of a lifeboat which is constructed so as to be incapable of deterioration by the elements, even when stored for long periods of time on exposed parts of a ship without maintenance.

It is another object of the instant invention to provide a lifeboat which is simple in construction, which is inexpensive to manufacture, and which is capable of a long life of useful service with a minimum of maintenance.

A still further object of the invention is the provision of a lifeboat which, when projected into the water in any aspect, immediately turns into a predetermined upright position.

It is a further object of the invention to provide a lifeboat which is buoyant and stable even when the interior has been filled with sea water.

It is a still further object of the present invention to provide a life boat which provides protection from the passengers from the sun in hot weather and from the cold in cold weather.

Another object of the invention is the provision of a lifeboat having a hatch cover which cannot be rendered inoperative by freezing, which is easily provided with a drogue, which has a large supply of fresh water that can serve a secondary function as ballast, which provides a means for accumulating fresh water from rain fall, which provides comfortable seating for a large number of passengers in such a way as to maintain the boat in balance, which is capable of being towed without difficulty, in which the means for gaining access to the hatchway from the water cannot be lost or destroyed, and which conforms in every way to regulations and specifications set forth by the Coast Guard for such use.

With these and other objects in view, as will be apparent to those skilled in the art, the invention resides in the combination of parts set forth in the specification and covered by the claims appended hereto.

BRIEF DESCRIPTION OF THE INVENTION

In general, the invention consists of a lifeboat having a main body with an outer surface in the shape of a prolate spheroid and having an inner chamber with a surface that is generally concentric with the outer surface. A keel formed of heavy material extends from one end to the other of the main body along a bottom portion. A hatchway aperture is located on an upper portion of the main body intermediate of the ends.

More specifically, a hatch having the general shape of the aperature is slidably carried on the outside of the main body and movable from a first position where it resides in sealing relation to the aperture to a second position where it lies outside the chamber and is noncoextensive with aperture. An upwardly-extending flange in the form of a closed plane figure is integrally formed with the upper portion and surrounds the hatchway aperture. A recess is formed in the outer surface of the main body and is provided with a cover which can be set free from the inner chamber to release a stabilizing anchor or the like. A fixed layer of flotation material is applied to the inner surface of the chamber in the upper portion thereof. The main body is formed with an outer skin of fiberglass-reinforced high-density polymer and the flotation material is a foamed polymer. A hollow ballast element extends entirely around the periphery of the main body and under a floor at the bottom of the inner chamber, the ballast element being divided into a plurality of compartments by transverse walls, and having a flat horizontal upper wall for use as a seat or a floor. A downwardly-extending flange is integrally formed on the inner surface of the main body, surrounding the hatchway, the flange serving to trap air in the upper portion of the main body.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
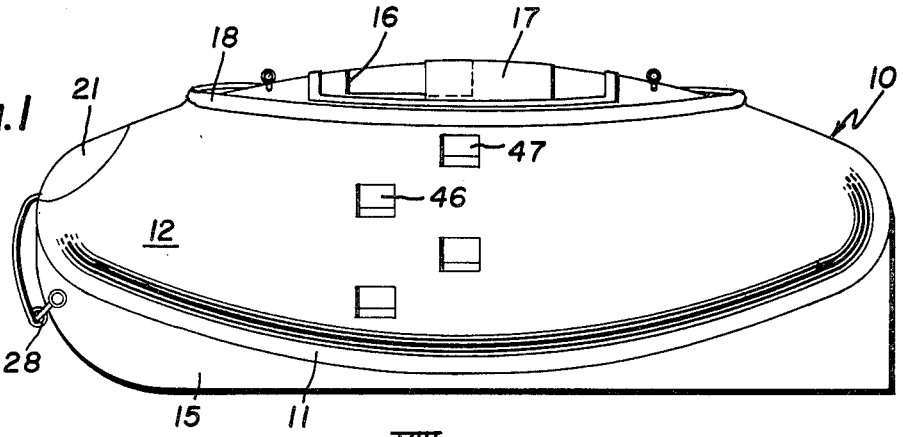
FIG. 1 is a perspective view of a lifeboat embodying the principles of the present invention.
Figure 2:
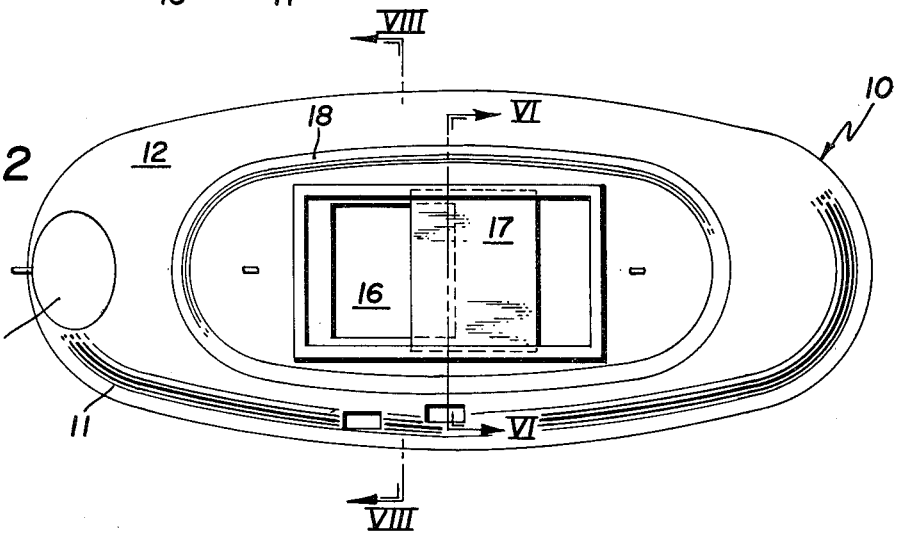
FIG. 2 is a plane view of the lifeboat.
Figure 3:
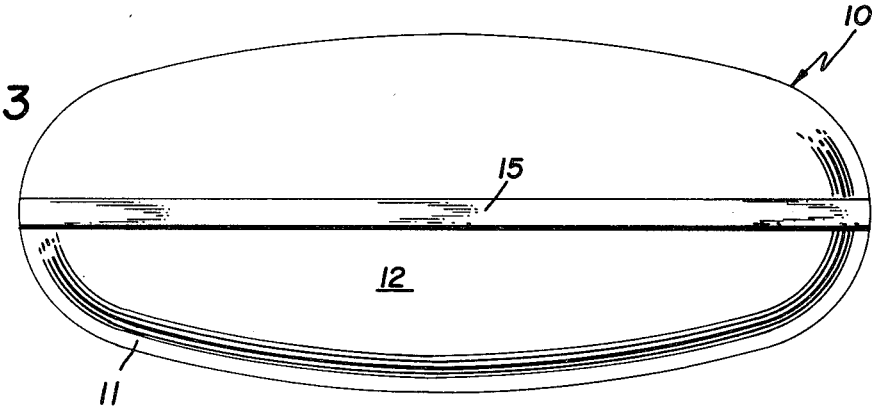
FIG. 3 is a bottom plane view of the lifeboat.
Figure 4:
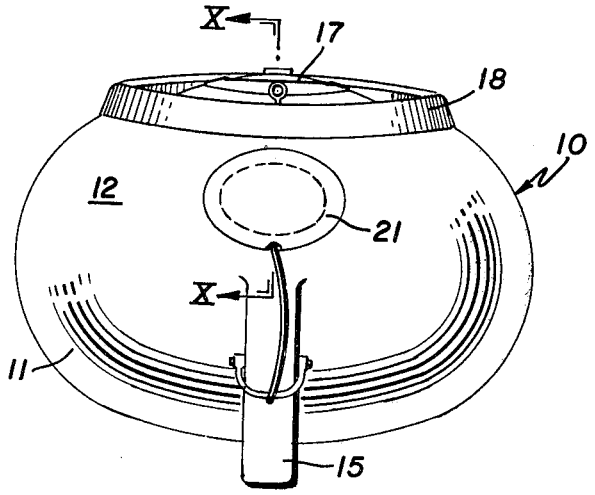
FIG. 4 is a front elevational view of the lifeboat taken on the bow end.
Figure 5:
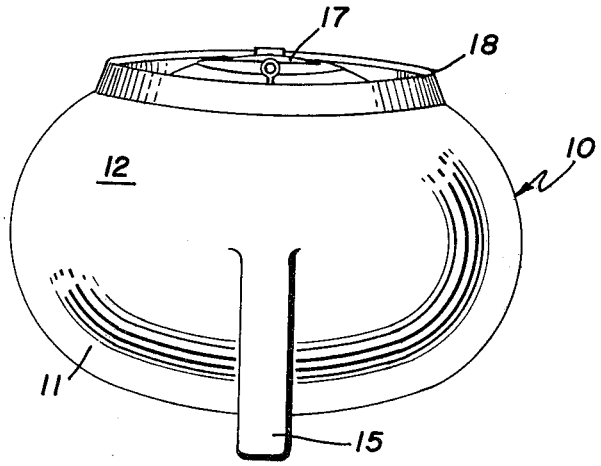
FIG. 5 is a rear elevational view of the invention taken on the stern end.

Referring first to FIGS. 1–5, which best show the general features of the invention, it can be seen that the lifeboat, indicated generally by the reference numeral 10, consists of a main body 11 having an outer surface 12 of generally prolate spheroidal shape. The main body has an inner chamber 13 whose surface 14 is generally concentric with the outer surface.

A keel 15, formed of heavy material such as lead, extends from end to end of the main body along the bottom portion. A hatchway aperture 16 is located in the upper portion intermediate of the ends and extends from the outer surface inwardly to the inner chamber. A hatch 17 having the same general shape as the aperture 16 is slidably carried on the inner surface of the main housing and is movable from a first position where it lies in sealing position with the aperture to a second position inside of the main body where it is non-coextensive with the aperture.

An outwardly-extending flange 18 is integrally formed with the outer surface 12 of the main body in the form of a closed plane figure that extends around and is substantially spaced from the hatchway aperture 16. The flange 18 serves to inhibit wave flow into the aperture and serves to collect rain water.

Figure 10:
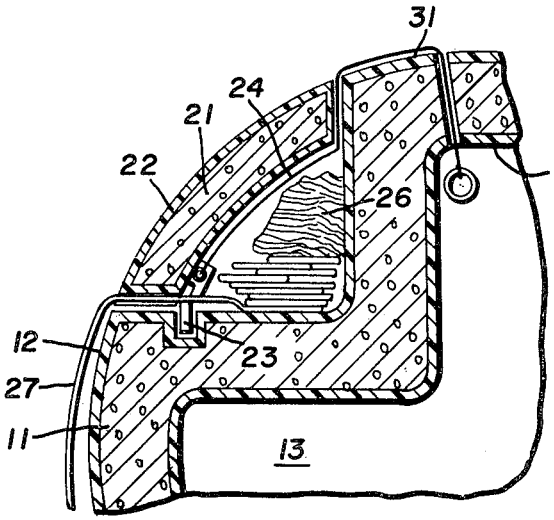
FIG. 10 is a sectional view of a portion of the lifeboat taken on the line X—X of FIG. 4.

Referring next to FIG. 10, a storage recess 19 is formed on the surface of the main body at the upper portion of the bow and a cover 21 is carried in the recess with an outer surface 22 that fairs into the outer surface 12 of the main body. A locking means 23, including a latch that serves to hold the cover in place. The locking means is releasable by means of a line 24 from the inner chamber 13 to open the cover 21 and release a drogue 26 which is normally stored within the recess and can be freed by removing the cover. The drogue is connected by a cable 27 to a bow ring 28 fixed to the main body.

Figure 8:
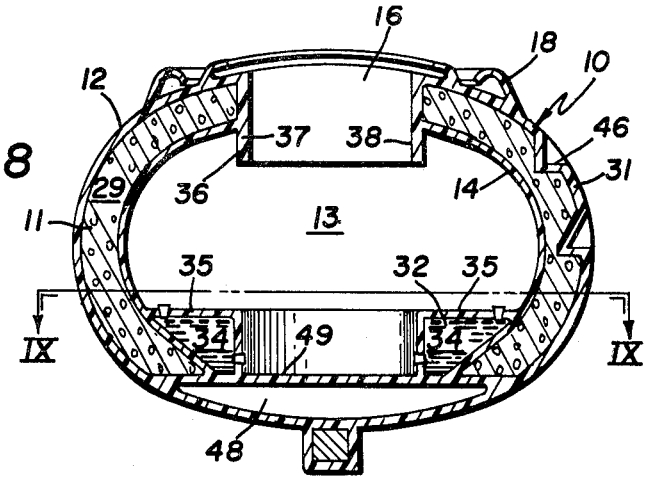
FIG. 8 is a vertical sectional view of the lifeboat taken on the line VIII—VIII of FIG. 2.
Figure 9:
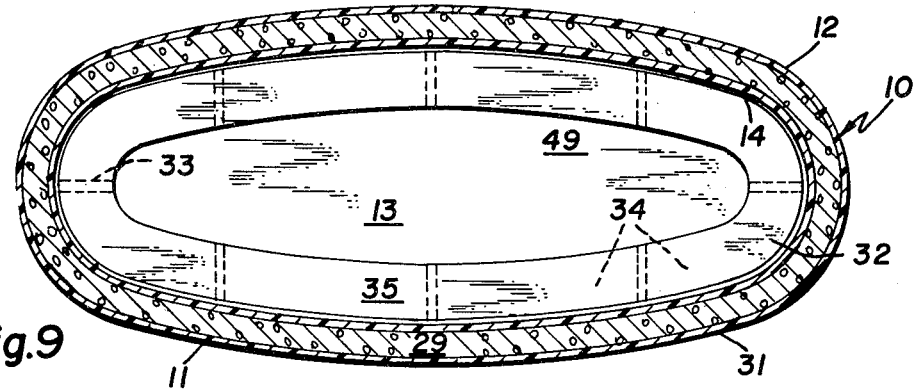
FIG. 9 is a horizontal sectional view of the lifeboat taken on the line IX—IX of FIG. 8.

As is best evident in FIGS. 8 and 9, a thick layer 29 of flotation material is applied to the surface of the inner chamber 13 at the upper portion of the main body. The main body is formed with an outer skin 31 of fiberglass-reinforced high-density polymer and the flotation material is a foamed polymer such as polyurethane. A hollow ballast element 32 extends entirely around the periphery of the inner chamber 13 at the bottom portion thereof. The element is divided by transverse walls 33 into compartments 34 which are adapted to carry fresh water. The ballast element 32 is provided with a flat upper surface 35 which permits its use as a seat for the passengers. The bottom of the chamber is provided with a floor 49 defining a chamber 48 which also carries fresh water for ballast and for drinking.

Figure 6:
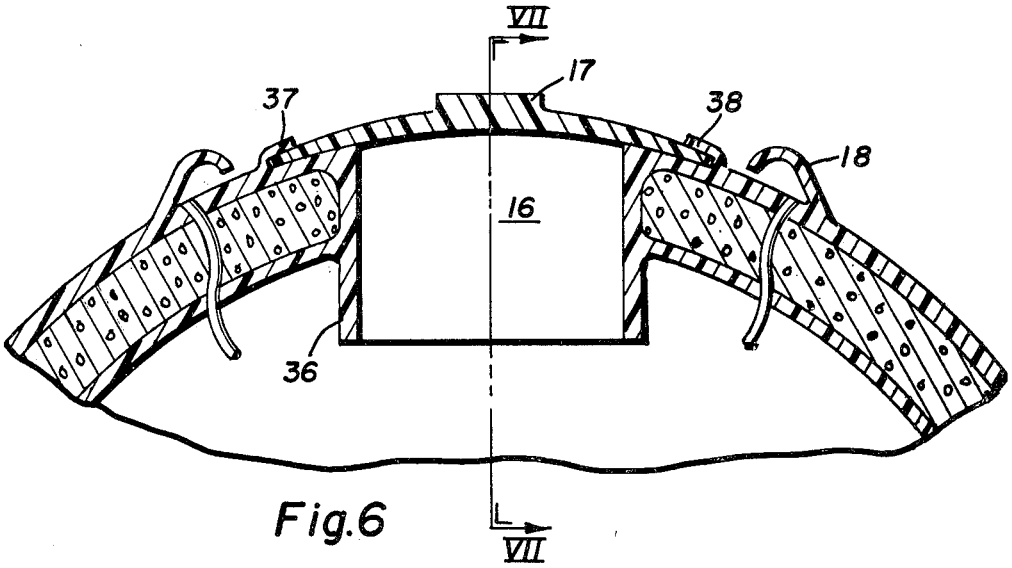
FIG. 6 is a vertical sectional view of the lifeboat taken on the line VI—VI of FIG. 2.
Figure 7:
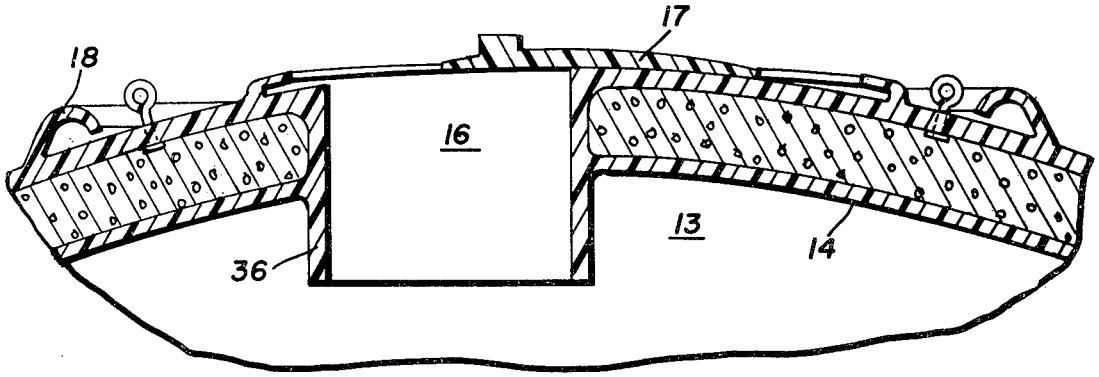
FIG. 7 is a vertical sectional view of the lifeboat taken on the line VII—VII of FIG. 6.

FIGS. 6, 7, and 8 show the details of a downwardly-extending apron 36 which is integrally formed on the surface of the inner chamber 13 in the shape of a closed plane figure that extends around the hatchway aperture 16. The flange serves to trap air in the upper portion of the chamber. The hatchway aperture 16 and the hatch 17 are both of generallly rectangular shape. Straight guides 37 and 38 are formed on the outside surface of the lifeboat and extend parallel to the sides of the aperture to carry the hatch for sliding movement relative to the aperture.

A series of step recesses 46 and 47 are shown in FIG. 1 as integrally formed in the outer surface 12 of the main body in the vicinity of the hatchway aperture 16.

As is best evident in FIG. 8, the bottom includes the compartment 48 of circular segmental cross-sectional form which is integrally formed in the bottom portion of the inner chamber 13 of the main body and has a flat upper surface 49 that acts as a floor for the inner chamber.

In the preferred embodiment, two of the compartments 34 in the ballast element 35 are provided with covers and are used for storage of miscellaneous equipment, rather than the storage of fresh water. As is evident in FIG. 7, the wall of the main body within the flange 18 is provided with hoses which permit the drainage of fresh water into the ballast compartment 48. Similarly, as is evident in FIG. 8, each compartment 34 is provided with similar inlet and outlet stoppers for introduction and removal of fresh water. Means is also provided to add and to remove fresh water from the compartment 13.

The operation and advantages of the present invention will now be readily understood in view of the above description. The lifeboat 10 normally floats in the condition shown in FIG. 1 with the keel 15 facing downwardly and with the hatchway 16 facing upwardly. In the preferred embodiment, the lifeboat is approximately 16 ft. long with a 6½ ft. beam and a 5 ft. height. Approximately 60 gallons of drinking water is carried in the ballast compartment 48. The weight of the keel 15 is 300 lbs. The flotation layer 29 consists of 4 inches of Styrofoam which has a buoyancy of 20 lbs. per sq. ft. In general, the lifeboat's weight is approximately 5 lbs. per sq. ft. and the hatch is 4 ft.×3 ft. (12 sq. ft.). In the preferred embodiment, the suggested capacity is 8 to 12 men, but in actual testing, it proved to be capable of carrying 20 men aboard the lifeboat in the water. In a further test of the preferred embodiment, it was suspended by the stern lifting eye, hoisted 20 ft. above the water; when the line was released, the lifeboat dropped with its hatch wide open and plunged into the harbor bow first and shot completely out of the water again like a sub-launched missile. During the test, the crane line was attached to the keel of the craft and it was rolled onto its side with its 12 sq. ft. of hatch still open to the sea. Sea water poured in and abruptly stopped, even held on its side with its compartment awash the lifeboat floated high in the water. The fiberglass-reinforced plastic is selected to be fire retardant and the craft is self-righting. The flotation layer 29 offers insulation against temperature extremes and gives the boat its buoyancy. The buoyancy capacity is twice the weight of the boat. If desired, the fresh water in the compartments 34 can be separately carried in plastic bags with a suitable cap. Because of the separate compartments, if one of the compartment waters becomes contaminated with salt water for some reason, there are others available. It is contemplated that, when the fresh water is used up from one of the compartments, it would be filled with salt water to retain its ballast weight. However, fresh rain water can be replaced in the plastic container through the combing or flange 18 which rings the top side of the boat. The ring traps rain and, when the hose is opened inside the boat, the rain water flows through the hose and permits one to top off the fresh water tanks. When it is necessary to open the hatch, it can be moved from its closed position to an open position. It can be slid by hand to any desired amount of opening, such as the half-open position shown in FIG. 7. When partly opened, the hatch provides plenty of ventilation air. The boat is easily launched from all types of vehicles, because of its self-righting ability. As a matter of fact, a simple ramp system can be provided to hold the lifeboat on the mother boat and launch it because of this characteristic. It is, therefore, possible to avoid the use of davits and power winches. Preferably, the lifeboat would come equipped with a head, a storage compartment for food, flares and other gear, and a small Sterno stove. The drogue 26 can be released to act as a sea anchor to keep the boat from broaching and rolling.

It can be seen, then, that the present lifeboat is unsinkable, is self-righting, and will not collapse or swamp. It is capable of saving every survivor that is able to climb on board, since there is complete protection from the elements with adequate food and drinking water. The towing shackle is strong enough to be used for a towing line and the provision of the full keel facilitates true towing. This lifeboat meets all Coast Guard requirements and in addition provides that no survivor or gear can fall out for any reason. In the preferred embodiment, when the lifeboat was completely filled with water, will sit approximately 2 ft. out of the water. The construction of the lifeboat is such that it would be possible to lift it with a helicopter, so that the complete lifeboat with the survivors inside can be hoisted to the helicopter's underside where the survivors could pass to the inside of the helicopter, or stay in the lifeboat until the lands. The passengers, of course, are protected from exposure from the elements. The flotation layer 29 not only prevents the heat of the sun from heating the interior of the lifeboat difficult in warm weather, but also protects it from the cold in the winter. In either case the passengers are protected from the sun and the cold air. It should be noted that in the winter it is possible for water splashed over the outer sides of the lifeboat to be frozen around the hatch 17. With this hatch design, the hatch can be opened simply by pushing up from the inside, thereby breaking the ice. The use of the apron 36 permits the trapping of air on the inside, which not only adds to the flotation of the entire lifeboat, but also provides a place for the passengers to obtain air in case of a sudden flooding of the lifeboat. The self-righting feature of course, comes about because of the fact that a substantial portion of the flotation equipment is above the water line in the area of the hatch 16, while all of the ballast is below the water line in the vicinity of the keel 15.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Lifeboat comprising:

(a) a main body having an outer skin with an outer surface of generally prolate spheroidal shape and an inner skin with an inner surface forming an inner chamber and being generally concentric with the outer surface of said skins, said outer and inner skins being formed of fiberglass-reinforced, high-density polymer and spaced apart in a parallel relationship to form a compartment therebetween, (b) a keel formed of heavy material extending from end to end of the main body along a bottom portion, a portion of said keel being a body of circular segmental form in cross-section integrally formed in the bottom portion of the inner chamber and having a flat upper surface that acts as a floor for the inner chamber, (c) a hatchway aperture located at the top of the main body intermediate of the ends thereof, (d) a hatch having the general shape of the aperture slidably carried on the main body and movable from a first position where it resides in sealing relation to the aperture to a second position where it is non-coextensive with the aperture, a downwardly-extending apron being integrally formed with both the inner and the outer skins and extending inwardly from the inner surface of the inner skin in the form of a closed plane figure that extends around the hatchway aperture, the apron serving to trap air in the upper portion of the inner chamber, the hatchway aperture and the hatch being of generally rectangular shape and straight guides being integrally formed on the outer skin of the main body parallel to the sides of the aperture to carry the hatch for sliding movement relative to the aperture, (e) an outwardly and upwardly-extending flange integrally formed on the outer skin surface of the main body in the form of a closed plane figure that extends around and is substantially spaced from the hatchway aperture, the flange serving to inhibit wave flow into the aperture and to collect rain water, and (f) a hollow ballast element extending entirely around the periphery of the inner chamber at the bottom portion thereof, the element being divided by transverse walls into a plurality of fresh water compartments, the element having a flat upper surface for use as a seat, and a water compartment is provided under the floor at the bottom of the inner chamber.

2. Lifeboat as recited in claim 1, wherein the compartment is filled with a thick layer of flotation material.

3. Lifeboat as recited in claim 1, wherein a series of step recesses are integrally formed in the outer surface of the main body in the vicinity of the hatchway aperture.

4. Lifeboat as recited in claim 1, wherein a thick layer of flotation material is applied to the surface of inner chamber at the upper portion of the main body.

5. Lifeboat as recited in claim 4, wherein the flotation material is a foamed polymer.

* * * * *